US006991512B2

(12) United States Patent
Taylor et al.

(10) Patent No.: US 6,991,512 B2
(45) Date of Patent: Jan. 31, 2006

(54) APPARATUS FOR EDGE POLISHING UNIFORMITY CONTROL

(75) Inventors: Travis Robert Taylor, Fremont, CA (US); Cangshan Xu, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 10/029,958

(22) Filed: Dec. 21, 2001

(65) Prior Publication Data

US 2002/0151256 A1 Oct. 17, 2002

Related U.S. Application Data

(63) Continuation-in-part of application No. 09/823,722, filed on Mar. 30, 2001, now Pat. No. 6,729,945.

(51) Int. Cl.
*B24B 7/22* (2006.01)

(52) U.S. Cl. ..... 451/5; 451/307

(58) Field of Classification Search ..... 451/5, 451/24, 296, 303, 307, 41
See application file for complete search history.

(56) References Cited

U.S. PATENT DOCUMENTS 5,916,012 A 6/1999 Pant et al.
6,093,089 A 7/2000 Chen et al.
6,155,915 A 12/2000 Raeder
6,186,865 B1 * 2/2001 Thorton et al. ..... 451/307
6,328,642 B1 12/2001 Pant et al.
6,336,845 B1 1/2002 Engdahl et al.
6,712,679 B2 3/2004 Taylor et al.

FOREIGN PATENT DOCUMENTS

| | | |
|---|---|---|
| EP | 0 706 857 | 4/1996 |
| EP | 0 914 906 | 5/1999 |
| TW | 416359 | 12/2000 |
| WO | WO 00 25982 | 5/2000 |

* cited by examiner

*Primary Examiner*—Robert A. Rose
(74) *Attorney, Agent, or Firm*—Martine Penilla & Gencarella, LLP

(57) ABSTRACT

An invention is provided for a platen for use in a CMP system. The platen includes an inner set of pressure sub regions capable of providing pressure to a polishing pad disposed above the platen. Each of the inner pressure sub regions is disposed below a wafer and within a circumference of the wafer. In addition, the platen includes an outer set of pressure sub regions capable of providing pressure to a polishing pad. Each of the outer set of pressure sub regions is disposed below the wafer and outside the circumference of the wafer. In this manner, the outer set of pressure sub regions is capable of shaping the polishing pad to achieve a particular removal rate.

6 Claims, 14 Drawing Sheets

APPARATUS FOR EDGE POLISHING UNIFORMITY CONTROL

CROSS REFERENCE TO RELATED APPLICATIONS

This application is continuation in part of U.S. patent application Ser. No. 09/823,722, filed Mar. 30, 2001 now U.S. Pat. No. 6,729,945, and entitled "Apparatus for Controlling Leading Edge and Trailing Edge Polishing," which is incorporated herein by reference in its entirety.

BACKGROUND OF THE INVENTION

1. Field of the Invention

This invention relates generally to chemical mechanical planarization apparatuses, and more particularly to methods and apparatuses for improved uniformity in chemical mechanical planarization applications via platen pressure zones outside the wafer's area.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12, which moves linearly in respect to the surface of the wafer 16. The belt 12 is a continuous belt rotating about rollers (or spindles) 20. A motor typically drives the rollers so that the rotational motion of the rollers 20 causes the polishing belt 12 to be driven in a linear motion 22 with respect to the wafer 16.

A wafer carrier 18 holds the wafer 16. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The polishing belt 12 is rotated by the rollers 20 which drives the polishing belt in the linear motion 22 with respect to the wafer 16. In one example, a fluid bearing platen 24 supports a section of the polishing belt under the region where the wafer 16 is applied. The platen 24 can then be used to apply fluid against the under surface of the supporting layer. The applied fluid thus forms a fluid bearing that creates a polishing pressure on the underside of the polishing belt 12 which is applied against the surface of the wafer 16. Unfortunately, because the polishing pressure produced by the fluid bearing typically cannot be controlled very well, the polishing pressure applied by the fluid bearing to different parts of the wafer 16 generally is non-uniform. Generally, uniformity requires all parameters defining the material removal rate to be evenly distributed across the entire contact surface that interfaces with the wafer.

Edge instabilities in CMP are among the most significant performance affecting issues and among the most complicated problems to resolve. FIG. 1C shows a linear polishing apparatus 10 illustrating edge effect non-uniformity factors. In this example, a wafer 16 is attached to a carrier 18, which applies pressure 13 to push the wafer 16 down on the polishing belt 12 that is moving over the platen 24. However, the polishing belt 12 deforms when the wafer contacts the polishing belt 12. Although the polishing belt 12 is a compressible medium, the polishing belt 12 has limited flexibility, which prevents the polishing belt 12 from conforming to the exact shape of the wafer 16, forming transient deformation zones 22 and 26. As a result, edge effects occur at the wafer edge 16*a* and 16*b* from a non-flat contact field resulting from redistributed contact forces. Hence, large variations in removal rates occur at the wafer edge 16*a* and 16*b*. Consequently, due to the fact that the prior art polishing belt designs do not properly control polishing dynamics, uneven polishing and inconsistent wafer polishing may result thereby decreasing wafer yield and increasing wafer costs.

In view of the foregoing, there is a need for an apparatus that overcomes the problems of the prior art by having a platen that improves polishing pressure control and reduces polishing pad deformation.

SUMMARY OF THE INVENTION

Broadly speaking, embodiments of the present invention fill these needs by providing a platen design that provides edge polishing uniformity control during a CMP process utilizing additional fluid zones outside the wafer's area. In one embodiment, a platen for use in a CMP system is disclosed. The platen includes an inner set of pressure sub regions capable of providing pressure to a polishing pad disposed above the platen. Each of the inner pressure sub regions is disposed below a wafer and within a circumference of the wafer. In addition, the platen includes an outer set of pressure sub regions capable of providing pressure to a polishing pad. Each of the outer set of pressure sub regions is disposed below the wafer and outside the circumference of the wafer. In this manner, the outer set of pressure sub regions is capable of shaping the polishing pad to achieve a particular removal rate. In one aspect, each sub region can comprise a plurality of output holes capable of facilitating pressure application to the polishing pad. For example, each plurality of output holes can provide gas pressure or liquid pressure to the polishing pad. Optionally, the first outer sub region and the second outer sub region can be controlled independently. In a further aspect, the platen can further comprise a leading zone and a trailing zone, where each of the leading and trailing zones includes an inner set of pressure sub regions and an outer set of pressure sub regions. Similar to above, the outer set of sub regions of each of the leading and trailing zones can include a first outer sub region and a second outer sub region that are controlled independently.

A method for improved wafer planarization in a CMP process is disclosed in another embodiment of the present invention. Pressure to a polishing belt is adjusted utilizing a platen having an inner set of pressure sub regions disposed below a wafer and within a circumference of the wafer. Additional removal rate profile manipulation is achieved by also adjusting pressure to the polishing belt utilizing an outer set of pressure sub regions of the platen. The outer set of pressure sub regions is disposed below the wafer and outside the circumference of the wafer. In this manner, the outer set of pressure sub regions is capable of shaping the polishing pad to achieve a particular removal rate. As above, the outer set of sub regions can include a first outer sub region and a second outer sub region that can be independently adjusted. Optionally, pressure provided in a leading zone and a trailing zone of the platen can be independently adjusted. In this aspect, each of the leading and trailing zones can include an inner set of pressure sub regions and an outer set of pressure sub regions. Also, the outer set of sub regions of each of the leading and trailing zones can include a first outer sub region and a second outer sub region, which can be independently adjusted.

In a further embodiment, a system is disclosed for use in CMP. The system includes a polishing belt, and a wafer carrier disposed above the polishing belt that is capable of applying a wafer to the polishing belt during a CMP process. The system further includes a platen that is disposed below the polishing belt. The platen includes an inner set of pressure sub regions that is capable of providing pressure to the polishing pad. Each inner pressure sub region is disposed below the wafer and within a circumference of the wafer. The platen further includes an outer set of pressure sub regions that is capable of providing pressure to the polishing pad. Each outer pressure sub region is disposed below the wafer and outside the circumference of the wafer. In this manner, the outer set of pressure sub regions is capable of shaping the polishing pad to achieve a particular removal rate.

Because of the advantageous effects of applying controlled pressure outside the area of the wafer utilizing the outer sub regions, embodiments of the present invention provide significant improvement in planarization while polishing in the area of pad deformities. Other aspects and advantages of the invention will become apparent from the following detailed description, taken in conjunction with the accompanying drawings, illustrating by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE PREFERRED EMBODIMENTS

An invention is disclosed for a platen design that provides edge polishing uniformity control during a CMP process utilizing additional pressure zones outside the wafer's area. In the following description, numerous specific details are set forth in order to provide a thorough understanding of the present invention. It will be apparent, however, to one skilled in the art that the present invention may be practiced without some or all of these specific details. In other instances, well known process steps have not been described in detail in order not to unnecessarily obscure the present invention.

In general, embodiments of the present invention provide a platen within a CMP system that has the unique ability to independently control polishing pressure outside the area of the wafer being polished, allowing the wafer polishing to be more consistent and efficient. Specifically, a platen of the embodiments of the present invention can manage the polishing pressures independently in several areas outside the area of the wafer. As a result, polishing pressure differences and inconsistencies arising from polishing pad pressure dynamics may be compensated for in a highly manageable manner.

A platen of the embodiments of the present invention may include any number of pressure zones outside the area of the wafer in addition to pressure zones within the wafer's area. Each pressure zone has a plurality of fluid holes that may be utilized to output fluid at different pressures thus compensating for polishing pad dynamics inadequacies. It should be understood that the embodiments of the present invention can be utilized for polishing any size wafer such as, for example, 200 mm wafers, 300 mm wafers.

A fluid as utilized herein may be any type of gas or liquid. Therefore, fluid platens as described below may utilize gas or liquid to control pressure applied by a polishing pad to a wafer by differing pressures on different portions of the polishing pad in contact with different regions of the wafer. In addition, embodiments of the present invention can implement mechanical devices to provide pressure to the polishing belt such as, for example, piezoelectric elements.

Figure 1A:
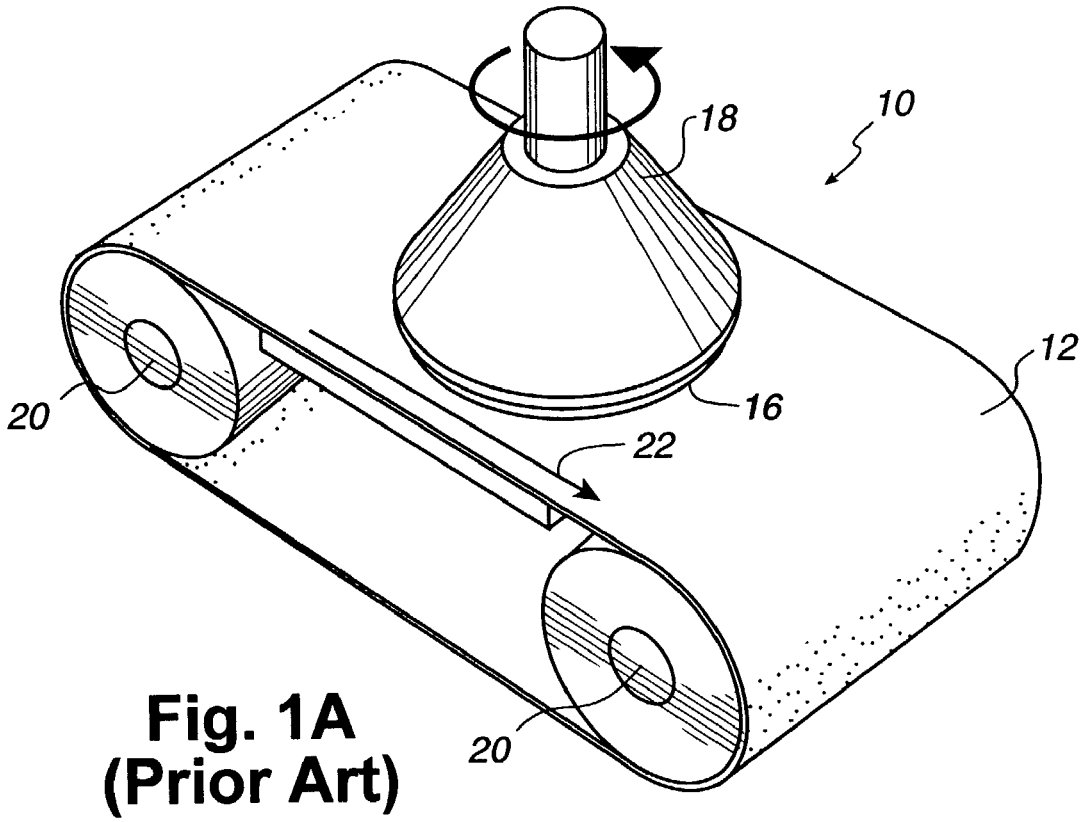
Fig. 1A (Prior Art)
FIG. 1A shows a linear polishing apparatus which is typically utilized in a CMP system.
Figure 1B:
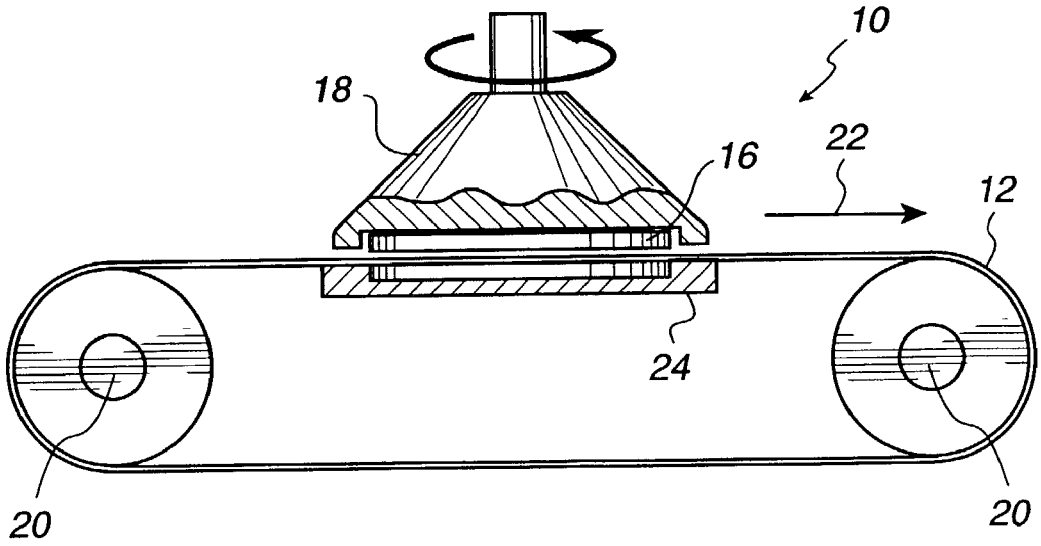
Fig. 1B (Prior Art)
FIG. 1B shows a side view of the linear polishing apparatus.
Figure 1C:
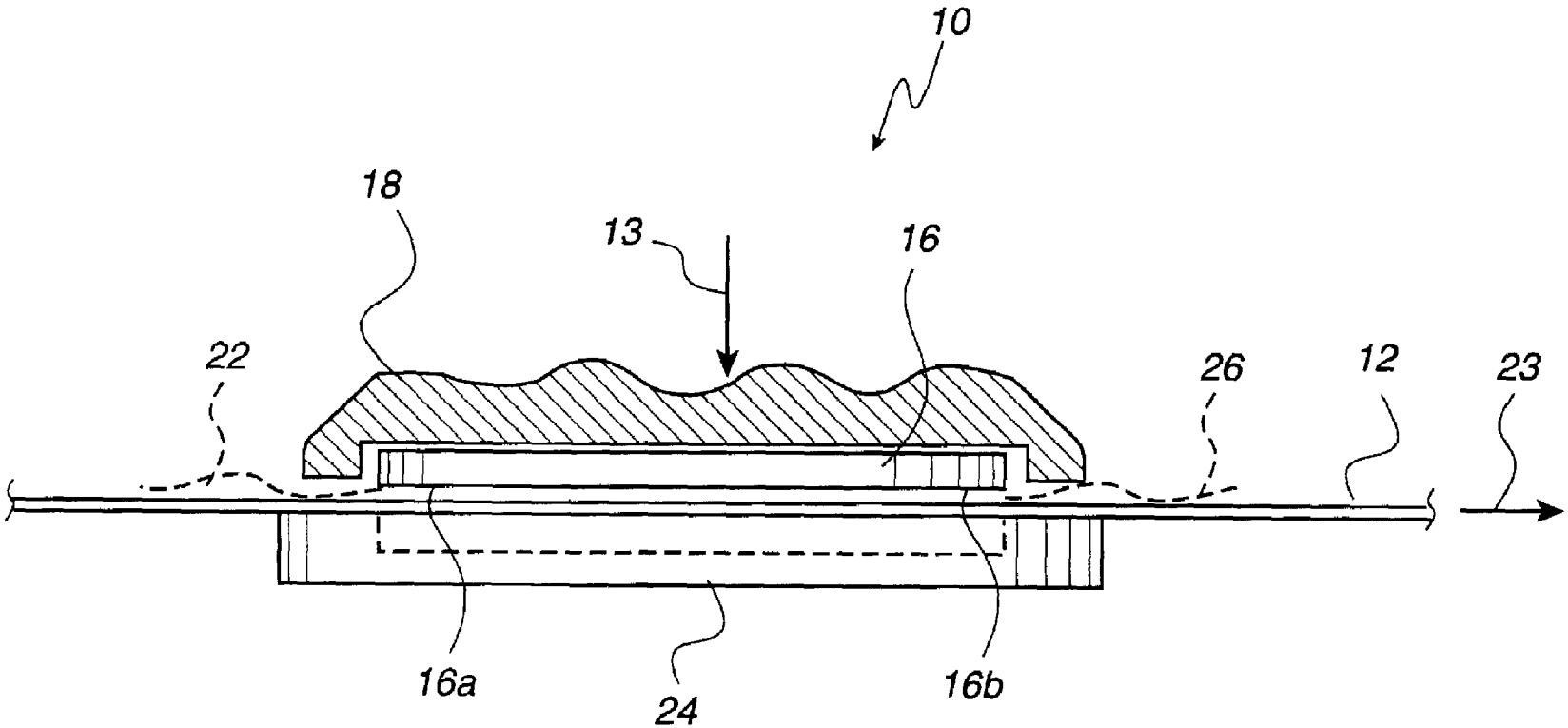
Fig. 1C (Prior Art)
FIG. 1C shows a linear polishing apparatus illustrating edge effect non-uniformity factors.
Figure 2A:
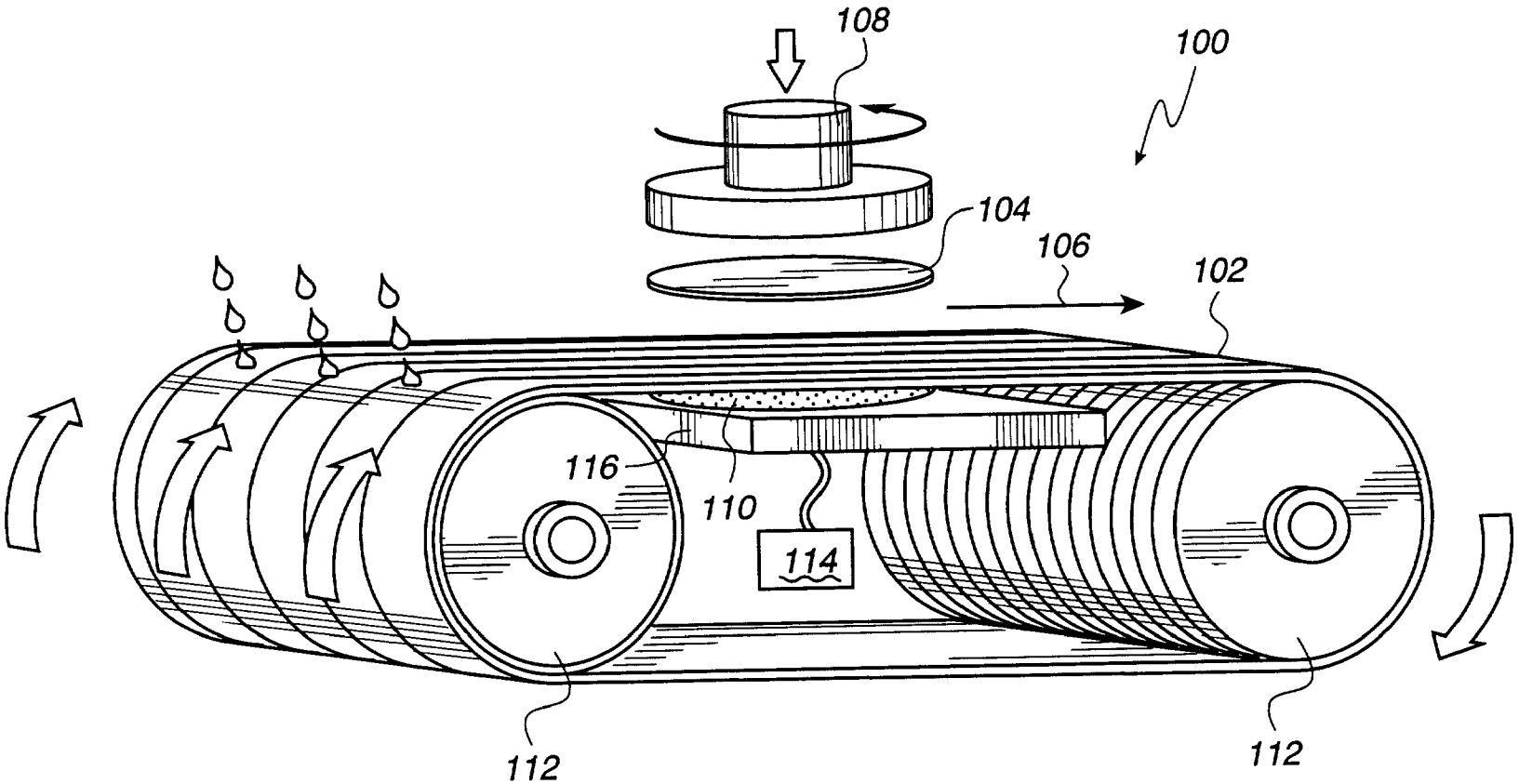
FIG. 2A shows a side view of a wafer linear polishing apparatus in accordance with an embodiment of the present invention.

FIG. 2A shows a side view of a wafer linear polishing apparatus 100 in accordance with an embodiment of the present invention. In this embodiment, a carrier head 108 may be used to secure and hold a wafer 104 in place during processing. A polishing pad 102 preferably forms a continuous loop around rotating drums 112. The polishing pad 102 generally moves in a direction 106 at a speed of about 400 feet per minute, however, it should be noted that this speed may vary depending upon the specific CMP operation. As the polishing pad 102 rotates, the carrier 108 may then be used to lower the wafer 104 onto a top surface of the polishing pad 102.

A platen manifold assembly 110 may support the polishing pad 102 during the polishing process. The platen manifold assembly 110 may utilize any type of bearing such as a liquid bearing or a gas bearing. A platen surround plate 116 supports and holds the platen manifold assembly 110 in place. Fluid pressure from a fluid source 114 inputted through the platen manifold assembly 110 by way of independently controlled pluralities of output holes may be utilized to provide upward force to the polishing pad 102 to control the polishing pad profile. As described below in reference to FIGS. 4–11, outside zones may apply pressure to the polishing pad 102 outside the area of the wafer 104 to reduce edge effect and other non-uniformity factors during CMP processing.

Figure 2B:
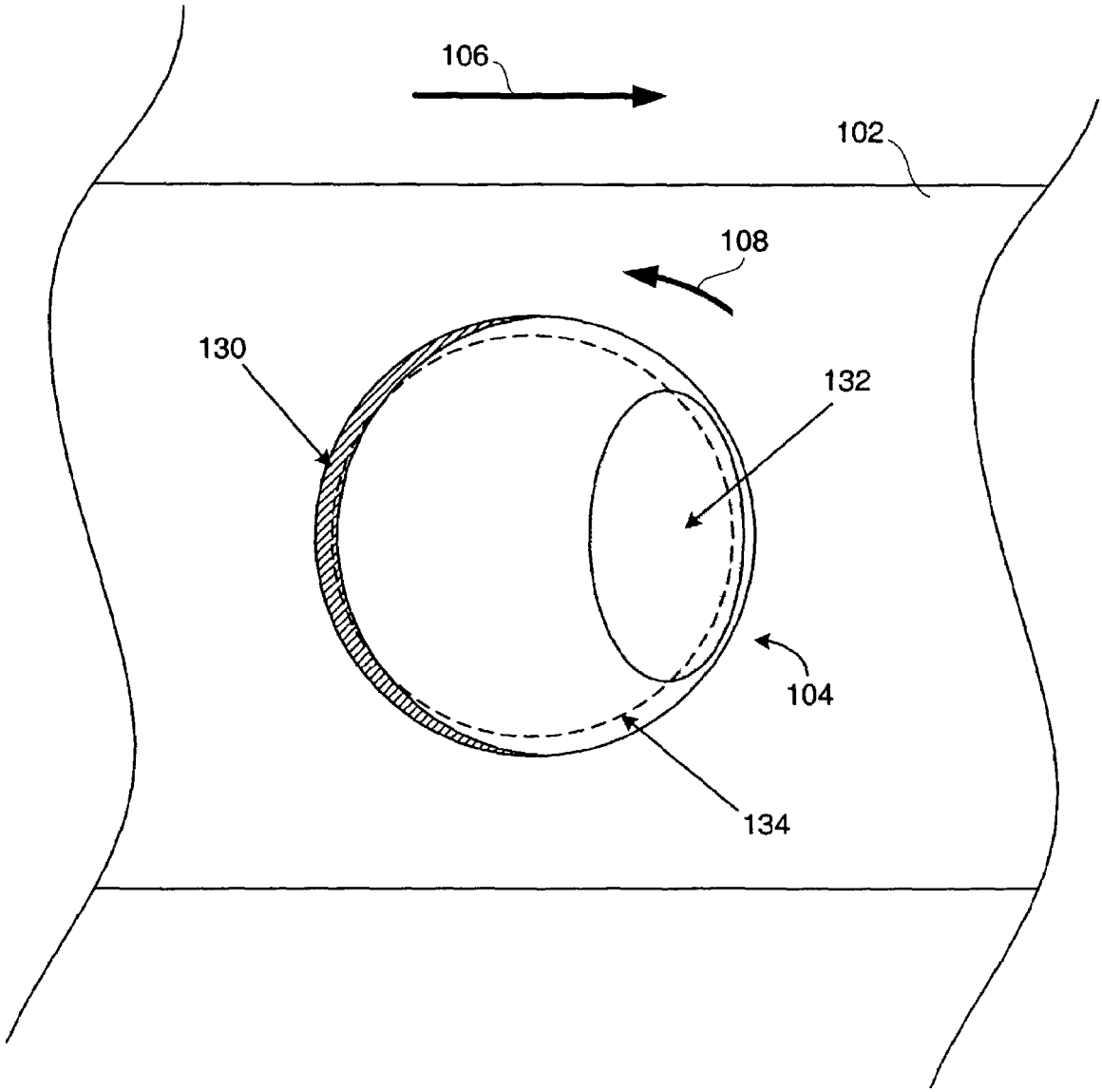
FIG. 2B is a diagram showing wafer planarization removal rates for a non-rotating wafer relative to the direction of movement of the polishing belt.

FIG. 2B is a diagram showing wafer planarization removal rates for a non-rotating wafer relative to the direction of movement of the polishing belt. In particular, FIG. 2B shows a non-rotating wafer 104 being planarized utilizing a polishing belt 102 moving in a direction 106 at a speed of about 400 feet per minute, however, as mentioned above it should be noted that this speed may vary depending upon the specific CMP operation. As the polishing pad 102 moves, a carrier lowers the wafer 104 onto a top surface of the polishing pad 102.

When the wafer 104 is not rotated, removal rate properties resulting from linear polishing can be seen that may be hidden when the wafer 104 is rotated. In particular, a fast removal rate area 130 develops at the leading edge of the wafer 104, and a slow removal rate area 132 develops at the trailing edge of the wafer 104. As a result, the fast removal rate area 130 and the slow removal rate area 132 cause non-uniformities during the CMP process. In particular, when the wafer 104 is rotated in a direction 108 during a typical CMP process, the removal rate is averaged along a radial averaging line 134. Hence, removal rate non-uniformities occur radially about the wafer's 104 area.

Figure 2C:
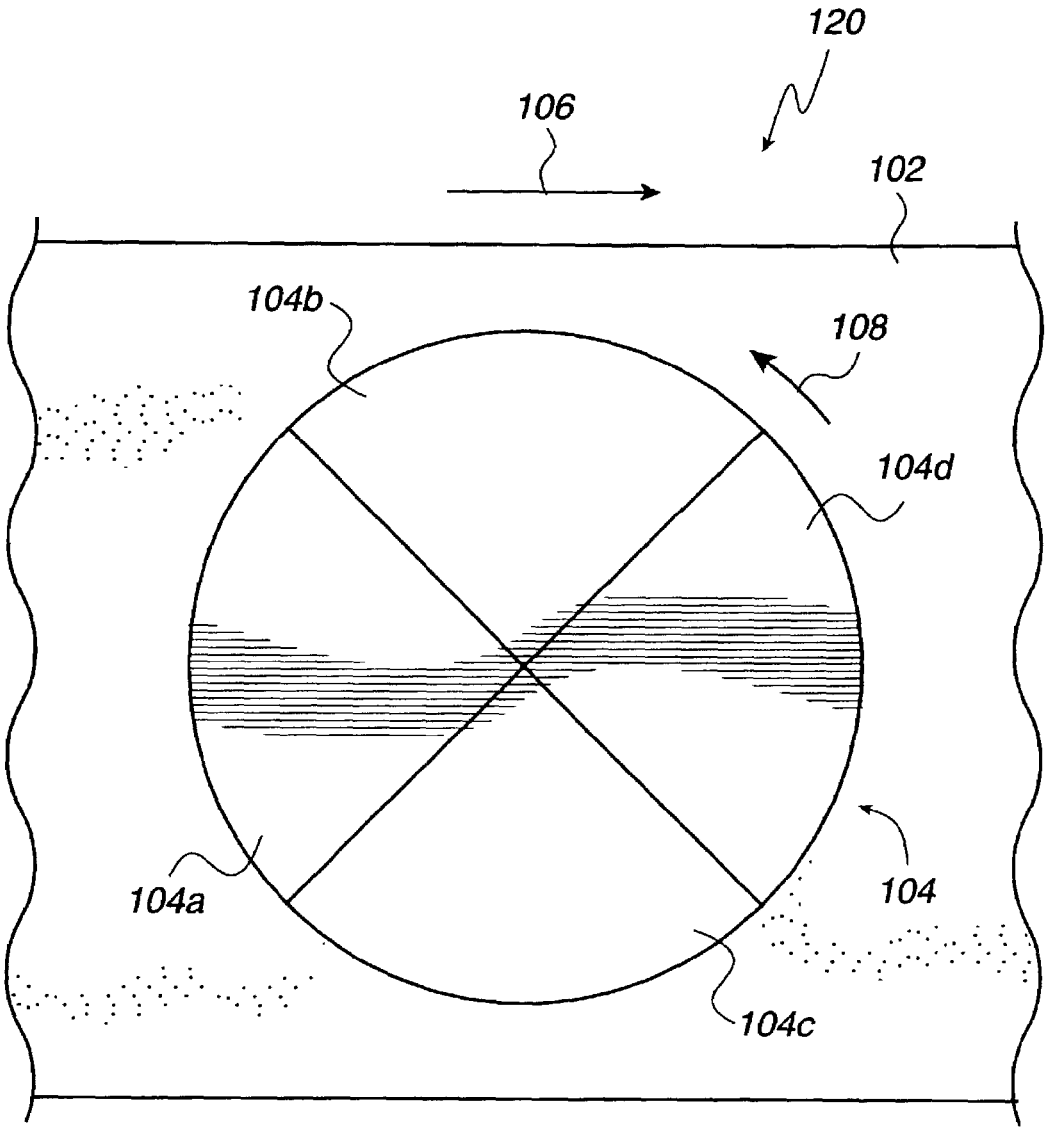
FIG. 2C shows a top view of a wafer linear polishing process as may be conducted by the linear polishing apparatus in accordance with an embodiment of the present invention.

The polishing rate generally is proportional to the amount of polishing pressure applied to the polishing pad 102 against the platen manifold assembly 110 (as shown in FIG. 2A) below the polishing pad 102. Hence, the rate of planarization may be changed by adjusting the polishing pressure. FIG. 2C shows a top view of a wafer linear polishing process 120 as may be conducted by the linear polishing apparatus in accordance with an embodiment of the present invention. As mentioned above with respect to FIG. 2B, the polishing pad 102 moves in a direction 106 producing a friction which assists in the polishing process.

In one embodiment, the wafer 104 may have four distinct polishing regions. However, it should be understood that although the embodiment described here has four polishing regions, the present invention may have any multitude of polishing regions or sub regions such as, for example, 5 regions, 6 regions, 7 regions, 8 regions, 9 regions, and so on. The four distinct polishing regions may be a leading edge polishing region 104*a* (also known as a leading zone), a side polishing region 104*c* (also known as a front zone), a side polishing region 104*b* (also known as a rear zone), and a trailing edge polishing region 104*d* (also known as a trailing zone).

The trailing edge region 104*d* tends to have less polishing pressure due to variations in polishing pad deformations, as illustrated in FIG. 2B. Also as illustrated in FIG. 2B, the differences in polishing pressures on the leading edge 104*a* and the trailing edge region 104*d* are significant. Therefore, through independent control of fluid pressure under the regions 104*a*–*d*, the polishing pressure, especially under regions outside the area of the wafer 104, may be adjusted to provide optimal and consistent polishing pressures over the different regions of the wafer 104. Consequently, embodiments of the present invention independently control the polishing pressures outside the area of the wafer in addition to areas within the area of the wafer to optimize the wafer polishing process.

Figure 3:
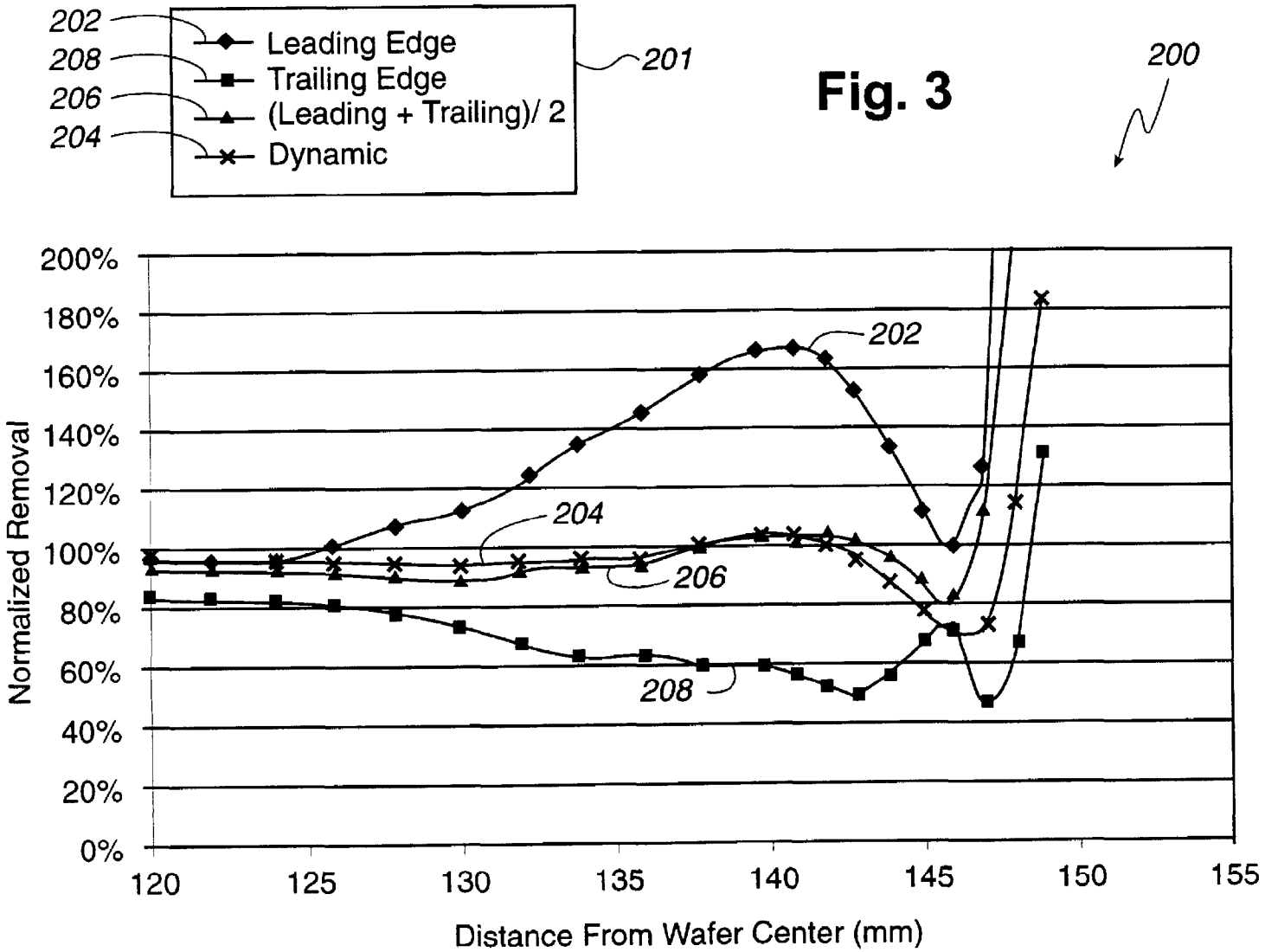
FIG. 3 shows a graph depicting differing polishing effects depending on the distance from the center of the wafer that the polishing is taking place, in accordance with one embodiment of the present invention.

FIG. 3 shows a graph 200 depicting differing polishing effects depending on the distance from the center of the wafer that the polishing is taking place, in accordance with one embodiment of the present invention. Graph 200 also includes a legend 201 indicating the names for curves shown on the graph 200. In one embodiment, the polishing rates of the leading edge 104*a* and the trailing edge 104*d* (as shown in FIG. 2C) are compared with a dynamic polishing rate, and curve of the average of the leading and trailing polishing rates, which is the leading and trailing polishing rates divided by 2.

A curve 202 shows a leading edge polishing profile, and a curve 208 shows a trailing edge polishing profile. In addition, a curve 204 shows a dynamic (when the wafer is spinning) polishing profile, and a curve 206 shows an average of the polishing profiles for the trailing edge and the leading edge. As can be seen, the trailing edge profile curve 208 has a lower and flatter normalized polishing removal than the leading edge profile curve 202. To alleviate the large differential in edge polishing, embodiments of the present invention utilize fluid pressures applied by a platen in regions outside of the contact area between the polishing pad and the wafer to increase polishing consistency during the CMP process. Therefore, the present invention may be utilized to flatten out the curves 202 and 208 to generate more consistent polishing on the edges of the wafer.

Figure 4A:
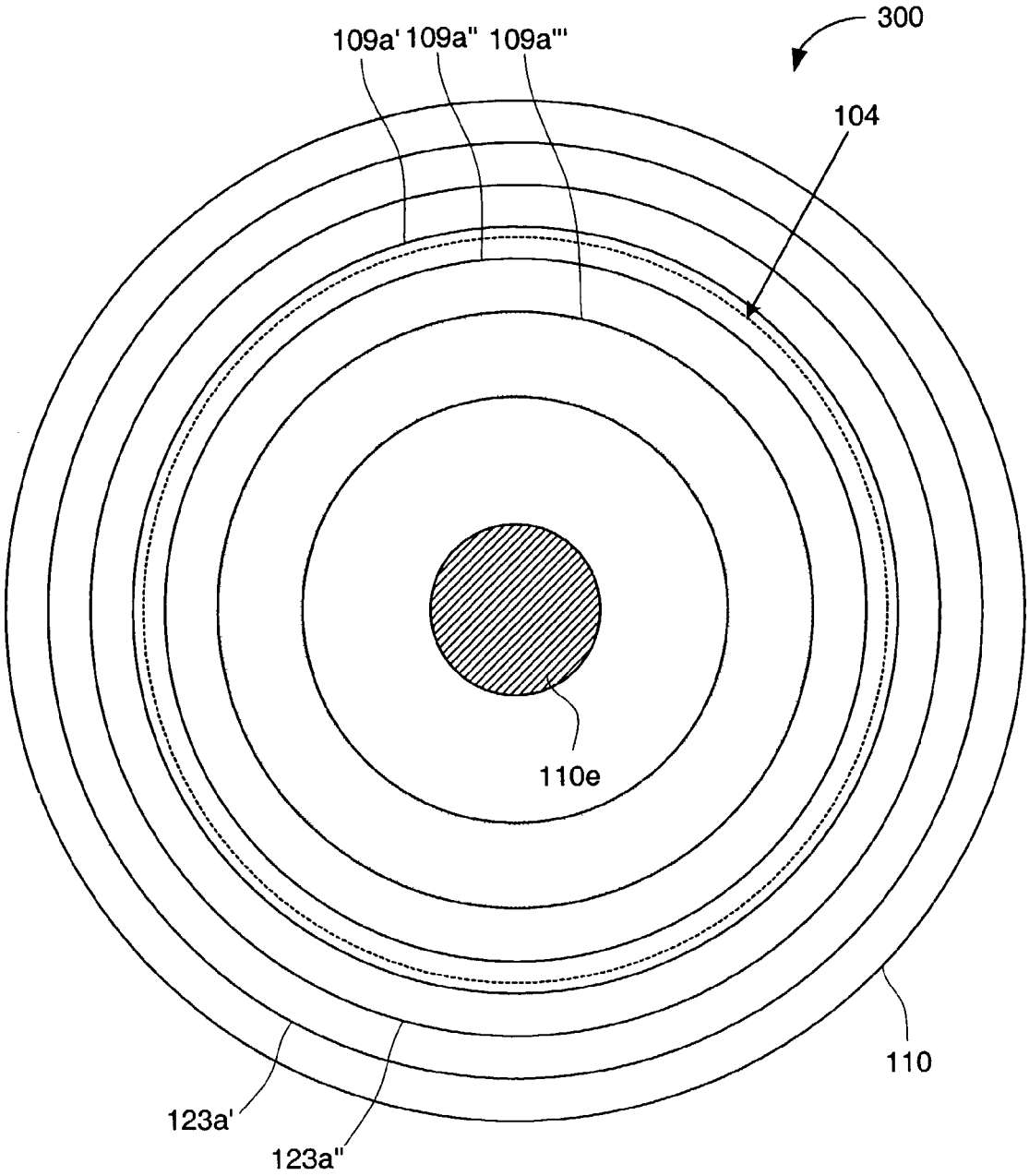
FIG. 4A is a diagram showing a fluid opening layout of a platen manifold assembly, in accordance with an embodiment of the present invention.

FIG. 4A is a diagram showing a fluid opening layout 300 of a platen manifold assembly 110, in accordance with an embodiment of the present invention. The platen manifold assembly 110 includes a plurality of sub regions each comprising a plurality of fluid outputs. In particular, the platen manifold assembly 110 includes three sub regions within the area of the wafer being polished, shown as area 104 in FIG. 4A, and three sub regions outside the area of the wafer 104.

Sub region 109*a*" comprises a radial row of a plurality of fluid outputs, while sub region 109*a*'" comprises three radial rows of a plurality of fluid outputs. The term radial rows as utilized herein are circular rows that are concentric with all other radial rows and have a common center with the platen manifold assembly 110. In addition, a center region 110*e* including a circular plurality of fluid outputs further is included that can be utilized to control the polishing pressures and the resulting polishing dynamics within the area of the wafer 104.

Sub region 109*a*' comprises a radial row of a plurality of fluid outputs, which are located at about the edge of or slightly outside the wafer area 104. In addition, two outside sub regions 123*a*' and 123*a*" form two additional independently controlled radial rows of a plurality of fluid outputs. By dividing the platen manifold assembly 110 into five sub regions each comprising a plurality of outputs, the platen manifold assembly 110 can intelligently, accurately, and precisely control polishing pressures on the wafer 104. In addition, because of the advantageous effects of applying controlled pressure outside the area of the wafer 104, utilizing sub regions 123*a*' and 123*a*", provides a significant planarization improvement while polishing in the area of pad deformities. In one embodiment, significant improvements can occur when polishing pressures are set to 0%, 50%, 50%, 50%, with the remaining fluid outputs being set to 0%. In this embodiment, sub region 123*a*' can be set to zero psi, sub region 123*a*" can be set to 50 psi, sub region 109*a*' can be set to 50 psi, and sub region 109*a*" can be set to 50 psi. However, it should be noted that other settings can be utilized to achieve desired removal rates utilizing the embodiments of the present invention. In addition, embodiments of the present invention can divide the platen manifold assembly into control regions for addition pressure control, as explained next with respect to FIG. 4B.

Figure 4B:
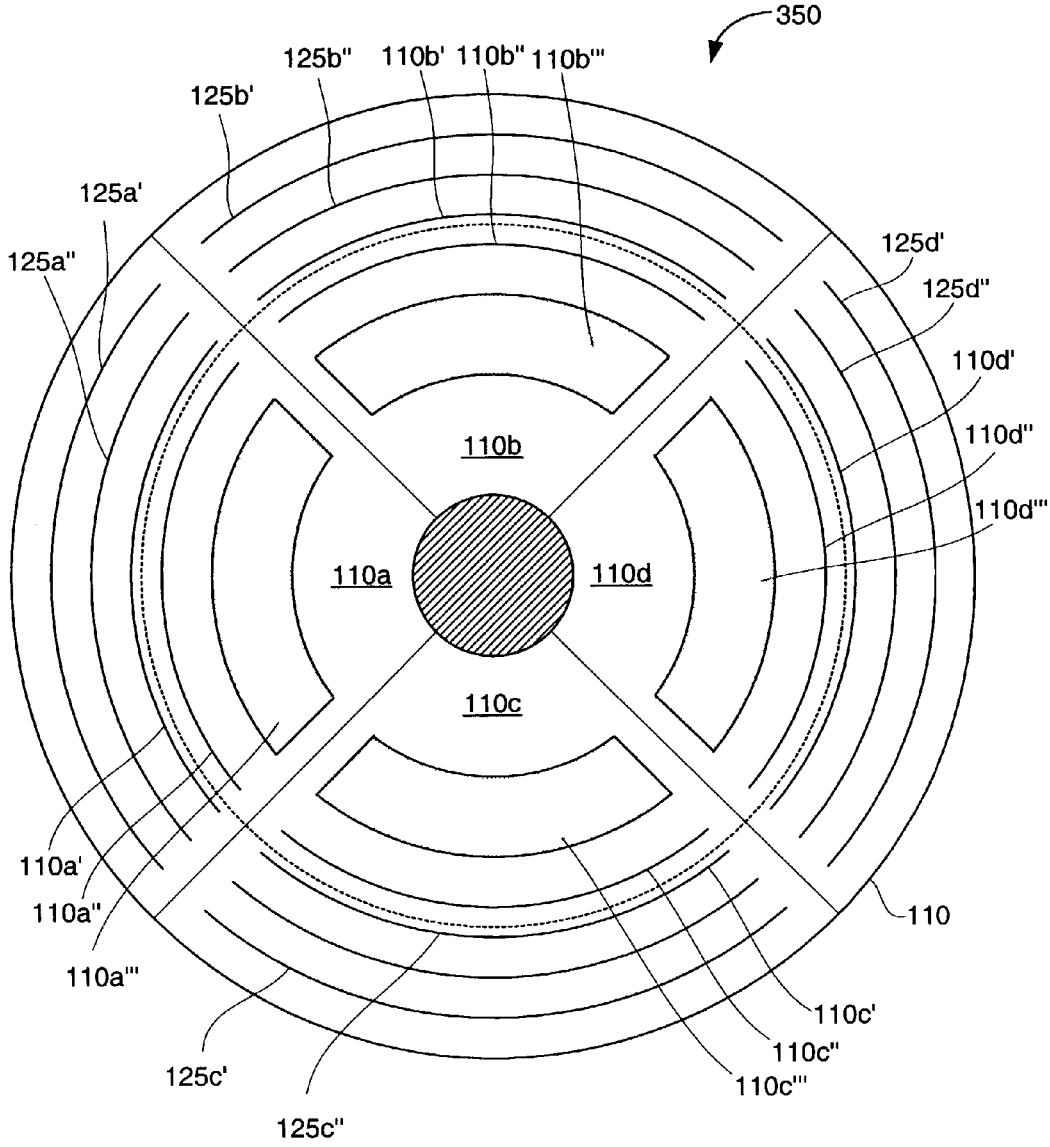
FIG. 4B is a diagram showing a fluid opening layout of a platen manifold assembly, in accordance with one embodiment of the present invention.

FIG. 4B is a diagram showing a fluid opening layout 350 of a platen manifold assembly 110, in accordance with one embodiment of the present invention. In this embodiment, the platen manifold assembly 110 is segregated into 4 major platen regions 110*a–d* controlling polishing pressure applied to 8 different parts of the wafer area 104. The platen regions 110*a–d* control polishing pressures on the regions 104*a–d* (as shown in FIG. 2C) of the wafer 104 respectively. The region 110*b* includes seven radial rows of a plurality of fluid outputs to control polishing pressure on a first side region of the platen manifold assembly 110. The region 110*c* includes include seven radial rows of a plurality of fluid outputs control polishing pressure on a second side region of the platen manifold assembly 110. Regions 110*b* and 110*c* can be implemented for separate individual control, or linked together, utilizing a single control mechanism. In one embodiment, each of the separately controllable regions such as the regions 110*a–d* may be designed to communicate independent fluid flows through the separately controllable regions to the underside of the linear polishing pad to intelligently control polishing pressure.

In a further embodiment, the region 110*a* (also known as the leading zone) and the region 110*d* (also known as the trailing zone) may be independently controlled and designed to output a controlled fluid flow independently from each of the first plurality of output holes in the leading zone and the second plurality of output holes in the trailing zone.

In one embodiment, the platen region 110*a* is a leading edge region that includes five sub regions each containing a plurality of fluid outputs. Sub region 110*a*' comprises a radial row of a plurality of fluid outputs, which is located at about the edge of or slightly outside the wafer area 104. In addition, two outside sub regions 125*a*' and 125*a*" form two additional independently controlled radial rows of a plurality of fluid outputs. Because of the advantageous effects of applying controlled pressure outside the area of the wafer 104, utilizing sub regions 125*a*' and 125*a*", a significant planarization improvement occurs while polishing in the area of pad deformities at the leading edge.

Two other sub regions in region 110*a* provide pressure within the area of the wafer 104. In particular, sub region 110*a*" includes a radial row of a plurality of fluid outputs, while sub region 110*a*'" includes three radial rows of a plurality of fluid outputs. By dividing the platen region 110*a* into five sub regions, three outside the wafer area 104 and two within the wafer area 104, the platen region 110*a* may intelligently, accurately, and precisely control polishing pressure on the leading edge region 104*a* of the wafer 104.

In addition, because of the advantageous effects of applying more minute control of the regions outside the area of the wafer 104, the single controllable radial rows of the sub regions 125*a*' and 125*a*" enables more accurate management of polishing pressure and provides a significant planarization improvement while polishing in the area of pad deformities. Also, the advantageous effects of applying more minute control of the outermost edges of the wafers, having single controllable radial rows of the sub regions 110*a*' and 110*a*" further enhances planarization ability while polishing in the area of pad deformities.

In one embodiment, the platen region 110*d* is a trailing edge region that includes five sub regions each containing a plurality of fluid outputs. Sub region 110*d*' comprises a radial row of a plurality of fluid outputs, which is located at about the edge of or slightly outside the wafer area 104. In addition, two outside sub regions 125*d*' and 125*d*" form two additional independently controlled radial rows of a plurality of fluid outputs. As above, a significant planarization improvement occurs while polishing in the area of pad deformities at the trailing edge because of the advantageous effects of applying controlled pressure outside the area of the wafer 104 utilizing sub regions 125*d*' and 125*d*".

Two other sub regions in region 110*d* provide pressure within the area of the wafer 104. In particular, sub region 110*d*" includes a radial row of a plurality of fluid outputs, while sub region 110*d*'" includes three radial rows of a plurality of fluid outputs. By dividing the platen region 110*d* into five sub regions, three outside the wafer area 104 and two within the wafer area 104, the platen region 110*d* may intelligently, accurately, and precisely control polishing pressure on the trailing edge region 104*d* of the wafer 104.

As with the leading edge, the single controllable radial rows of the sub regions 125*d*' and 125*d*" enables more accurate management of polishing pressure and provides a significant planarization improvement while polishing in the area of pad deformities because of the advantageous effects of applying more minute control of the regions outside the area of the wafer 104. Also, the advantageous effects of applying more minute control of the outermost edges of the wafers, having single controllable radial rows of the sub regions 110*d*' and 110*d*" further enhances planarization ability while polishing in the area of pad deformities.

The platen manifold assembly 110 may further include a center region 110*e* having a circular plurality of fluid outputs that can also be utilized to control the polishing pressures and the resulting polishing dynamics of the wafer 104. Consequently, embodiments of the present invention may control fluid pressure and the resultant polishing pressure by varying and adjusting fluid pressure in any, some, or all of the regions and sub regions, both within the wafer area 104 and outside the wafer area 104.

Figure 5:
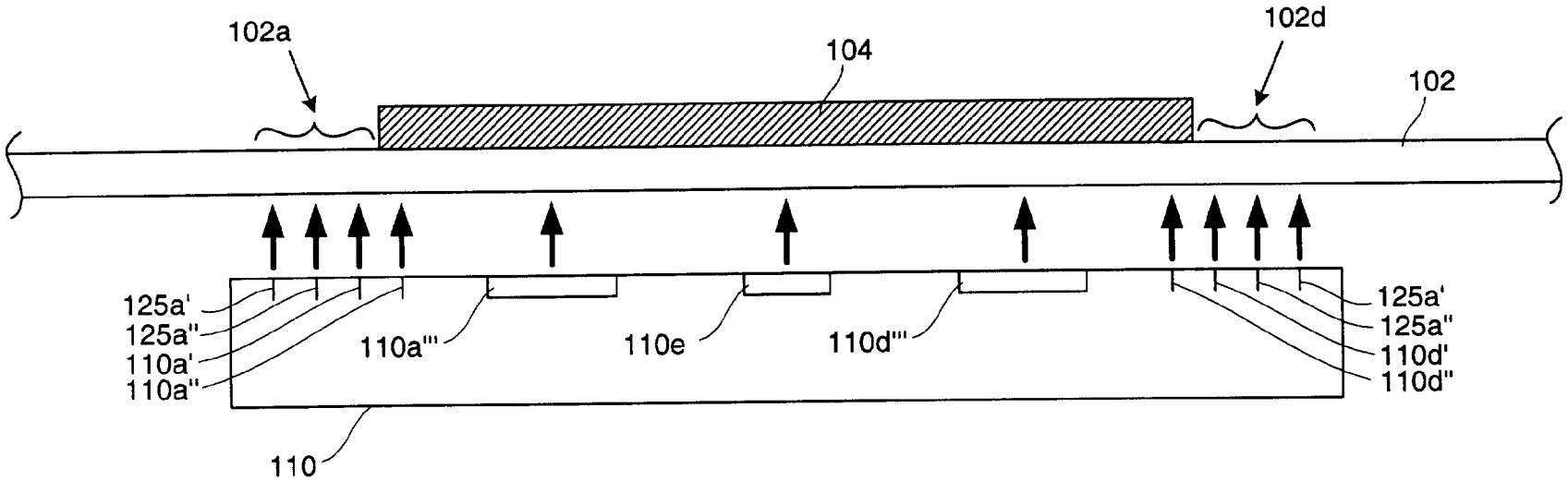
FIG. 5 is a side view of a platen manifold assembly having outside pressure zones, in accordance with an embodiment of the present invention.

FIG. 5 is a side view of a platen manifold assembly 110 having outside pressure zones, in accordance with an embodiment of the present invention. In the example of FIG. 5, the wafer 104 is pushed down on the polishing belt 102 that is moving over the platen manifold assembly 110. As mentioned above, the platen manifold assembly 110 includes five sub regions each containing a plurality of fluid outputs. Sub region 110*a*' comprises a radial row of a plurality of fluid outputs, which is located at about the edge of or slightly outside the wafer area 104. In addition, two outside sub regions 125*a*' and 125*a*" form two additional independently controlled radial rows of a plurality of fluid outputs. Two other sub regions provide pressure within the area of the wafer 104. In particular, sub region 110*a*" includes a radial row of a plurality of fluid outputs, while sub region 110*a*'" includes three radial rows of a plurality of fluid outputs.

Similarly, at the trailing edge of the platen manifold assembly 110, sub region 110*d*' comprises a radial row of a plurality of fluid outputs, which is located at about the edge of or slightly outside the wafer area 104. Two additional outside sub regions 125*d*' and 125*d*" form two independently controlled radial rows of a plurality of fluid outputs. As above, sub region 110*d*" includes a radial row of a plurality of fluid outputs, while sub region 110*d*'" includes three radial rows of a plurality of fluid outputs. These two sub regions provide pressure within the area of the wafer 104. Also, a center region 110*e* having a circular plurality of fluid outputs is utilized to provide additional control for polishing pressures of the wafer 104.

As shown in FIG. 5, the outside pressure sub regions 125*a*', 125*a*", 125*d*', and 125*d*" allow improved shaping of the polishing pad 102 in regions 102*a* and 102*d* of the polishing pad 102. The improved polishing pad 102 shaping provided by the outside pressure sub regions 125*a*', 125*a*", 125*d*', and 125*d*" greatly reduces edge effect and provides enhanced removal rate profiles.

Figure 6:
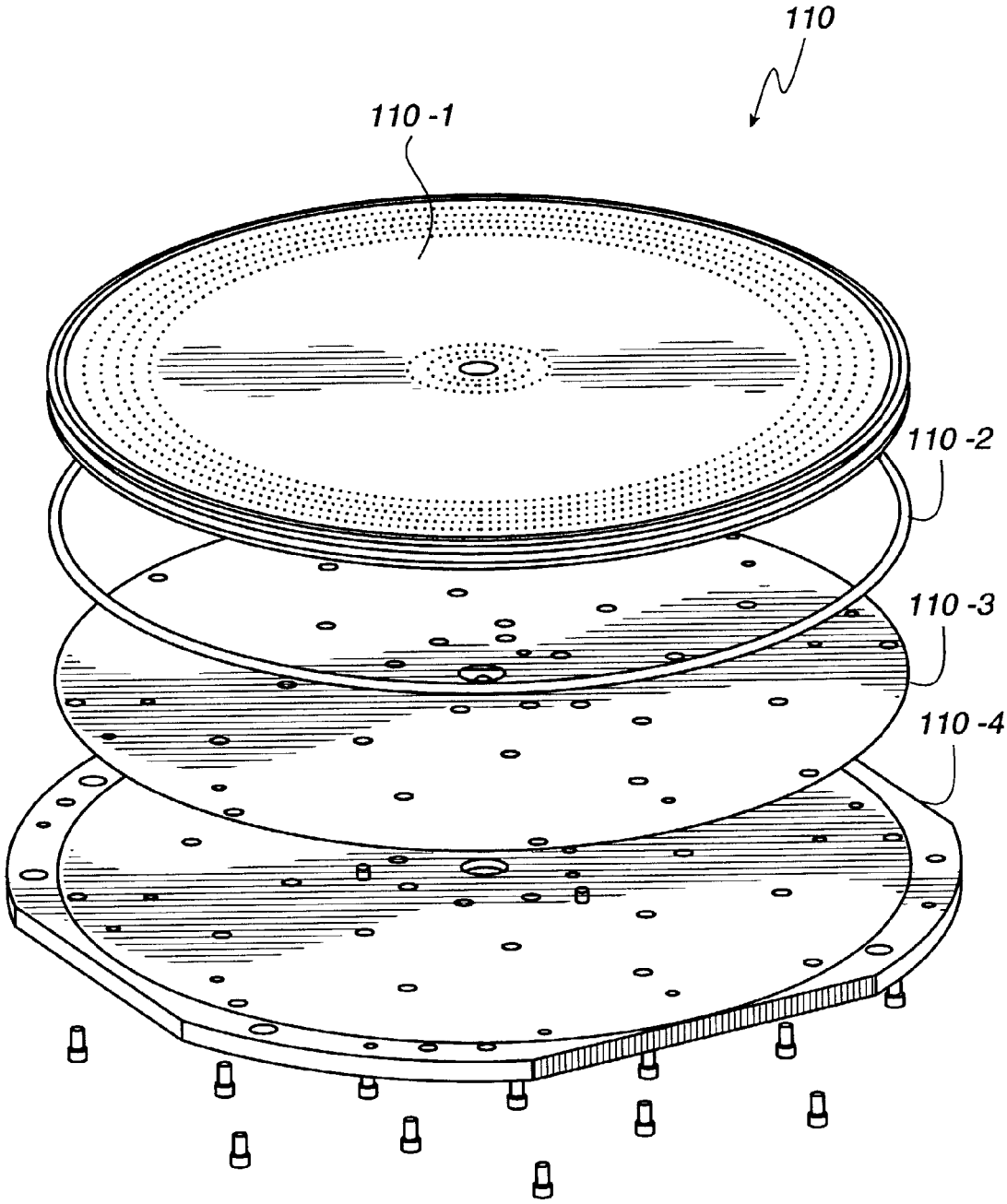
FIG. 6 illustrates a platen manifold assembly in accordance with one embodiment of the present invention.
Figure 10:
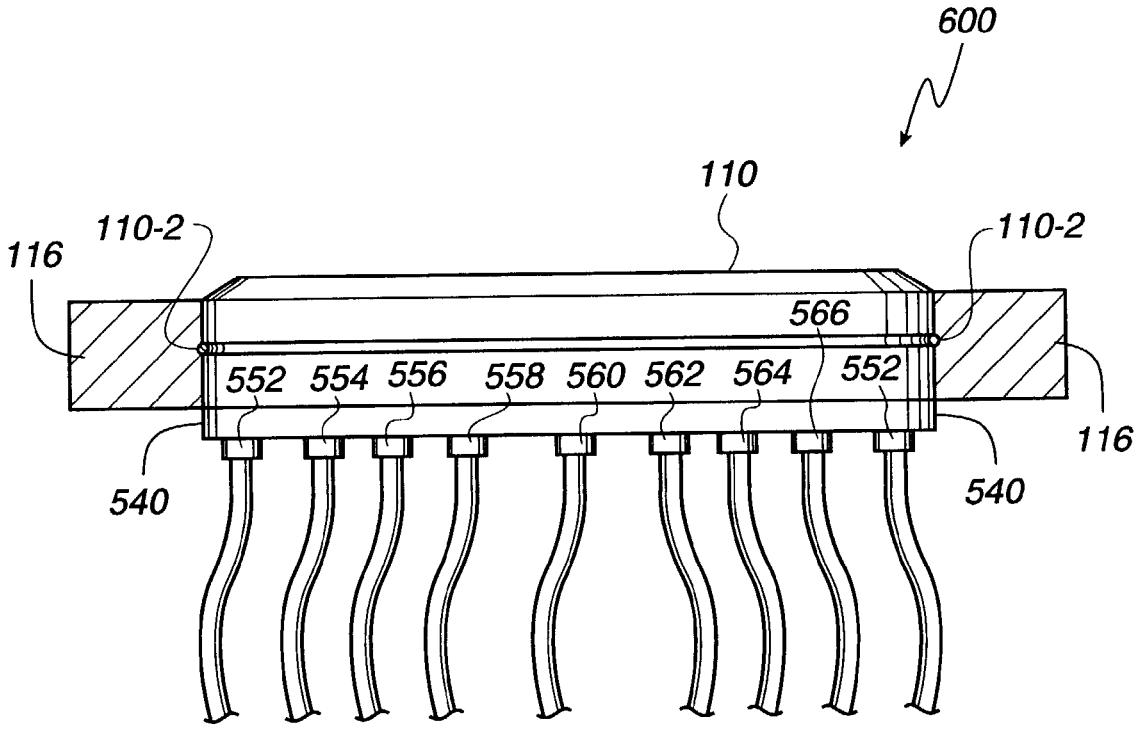
FIG. 10 shows a platen assembly with a platen manifold assembly, a platen interface assembly, and a platen surround plate in accordance with one embodiment of the present invention.

FIG. 6 illustrates a platen manifold assembly 110 in accordance with one embodiment of the present invention. In this embodiment, a rubber gasket 110-3 is sandwiched between a platen manifold assembly 110-1 and a base plate 110-4. Therefore, fluid tubes may be connected to a platen interface assembly 540 (shown in FIG. 10) which may transfer fluids to the platen 110-1. The o-ring 110-2 forms a seal to a platen surround plate 116 (shown in FIG. 11) so that contaminating fluids do not leak into the subsystem. Certain inputs located on the base plate 110-4, which correlate to the fluid tube inputs on the platen interface plate 540 (as shown in FIG. 10), may lead to certain regions or sub regions containing the plurality of fluid outputs so by controlling fluid introduction into the certain inputs, fluid output from the respective regions or sub regions may be controlled.

Figure 7:
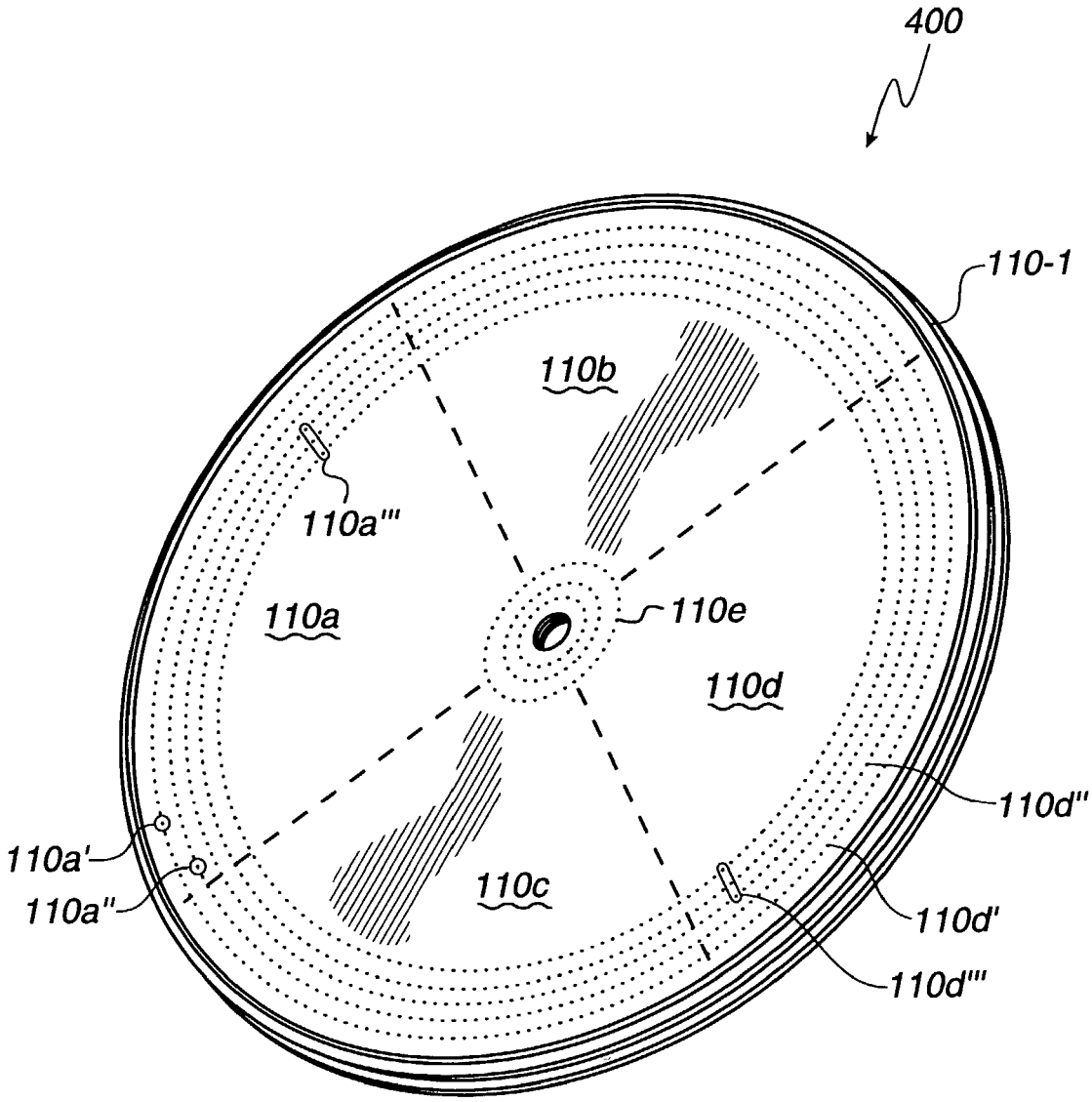
FIG. 7 shows a top view of the platen in accordance with one embodiment of the present invention.

FIG. 7 shows a top view 400 of the platen 110-1 in accordance with one embodiment of the present invention. In one embodiment, the platen 110-1 includes the 4 major regions 110*a–d* (as described in reference to FIG. 2C) that may be controlled to optimize edge polishing. The region 110*a* may include the sub regions 110*a*'–110*a*'". The sub region 110*a*' and the sub region 110*a*" can each contain a single radial row of a plurality of fluid outputs. Outputs from each of the sub regions 110*a*'–110*a*'" may be individually controlled thereby enabling intelligent dynamic fluid output pressure by the platen manifold assembly 110 in the region 110*a* of the leading edge. It should be understood that fluid outputs to the sub regions 110*a*'–110*a*'" may be varied in any way which would manage polishing pressure in the leading edge and produce a more efficient wafer polishing such as, for example, decreasing polishing pressure. In one embodiment, the outputs closer to the edge such as those in sub regions 110*a*' and 110*a*" may be utilized (to lower fluid pressure and therefore polishing pressure) to reduce polishing pressure in the leading edge region 110*a*. By having single radial rows of a plurality of fluid outputs that are each individually controllable, more minute adjustments may be made toward the edge of the platen manifold assembly 110 thereby managing polishing pressure in the regions where polishing pad deformations occur.

The region 10*d* includes the sub regions 110*d*'–110*a*'". Each of the sub regions 110*d*' and 110*d*" can be managed individually by different outputs of fluid which can allow intelligent dynamic fluid output pressure variation by the platen manifold assembly 110 in the region 110*d* of the trailing edge. It should be appreciated that outputs to the sub regions 110*d*'–110*d*'" may be individually varied in any manner than would reduce polishing pad deformity and thereby enable more consistent wafer polishing. In one embodiment, the sub regions 110*d*' and 110*d*" may have more fluid inputted into them thereby increasing fluid output from the platen which increases fluid pressure on the polishing pad which in turn increases polishing pressure in the trailing edge. Such increased trailing edge polishing pressure may equalize the polishing pressure with the leading edge polishing pressure thus generating increased wafer polishing uniformity in the different regions of the wafer.

In one embodiment, the platen 110-1 may have a plurality of output holes that are separately grouped so there is a first region and a second region of output holes. The first region of output holes and the second region of output holes may then be separately controlled so as to apply a different magnitude of the force to the leading edge of the wafer than the trailing edge of the wafer and therefore powerfully control polishing pressure applied to the leading edge of the wafer and the trailing edge of the wafer.

Figure 8:
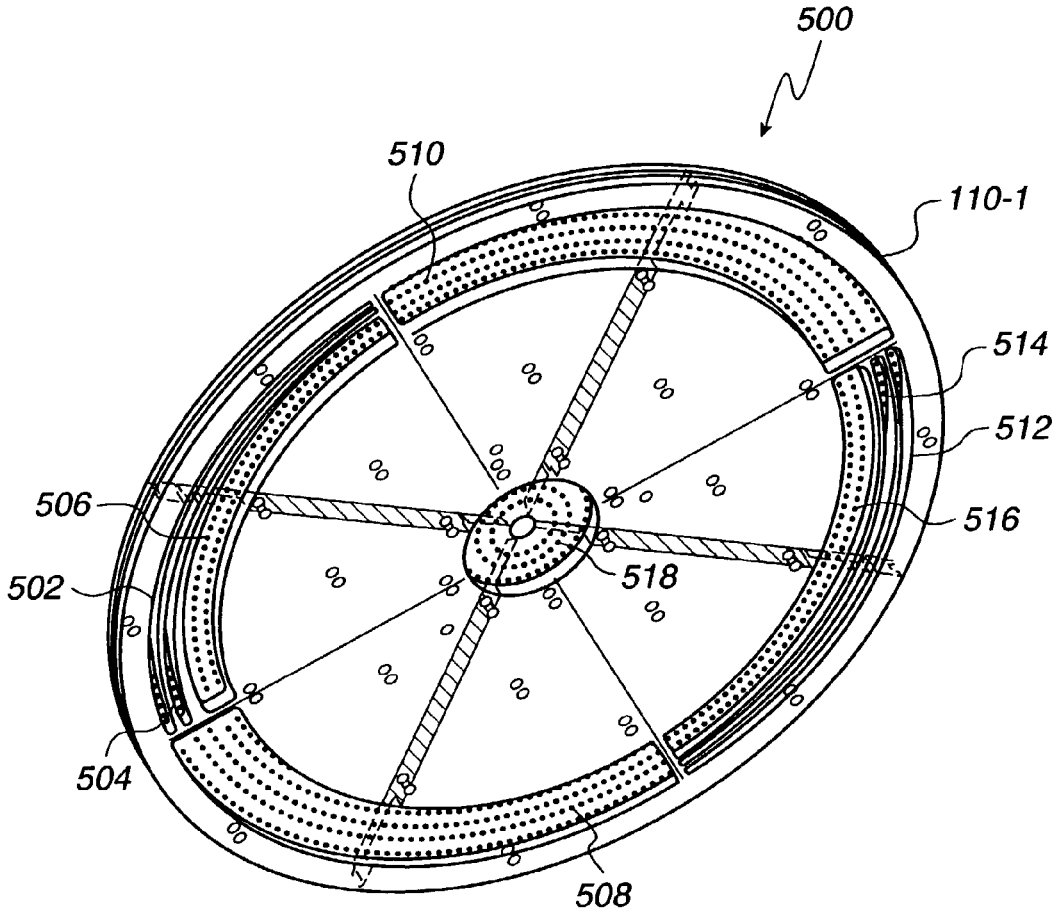
FIG. 8 shows a backside view of the platen in accordance with one embodiment of the present invention.

FIG. 8 shows a backside view 500 of the platen 110-1 in accordance with one embodiment of the present invention. In this embodiment, openings leading to the plurality of fluid outputs in the regions 110*a–e* (as shown in FIG. 7) can be seen. Openings 502, 504, 506, 512, 514, and 516 lead to a plurality of outputs in the sub regions 110*a*', 110*a*", 110*a*'", 110*d*', 110*d*", and 110*d*'" respectively. Also opening 508, 510, and 518 lead to a plurality of outputs in the regions 110*c*, 110*b*, and 110*e* respectively. Fluid input to each of the openings 502–518, fluid may be individually controlled so the different regions and sub regions containing the plurality of fluid outputs on the platen 110-1 may be managed to reduce polishing pressure differences between different parts of the wafer.

Figure 9:
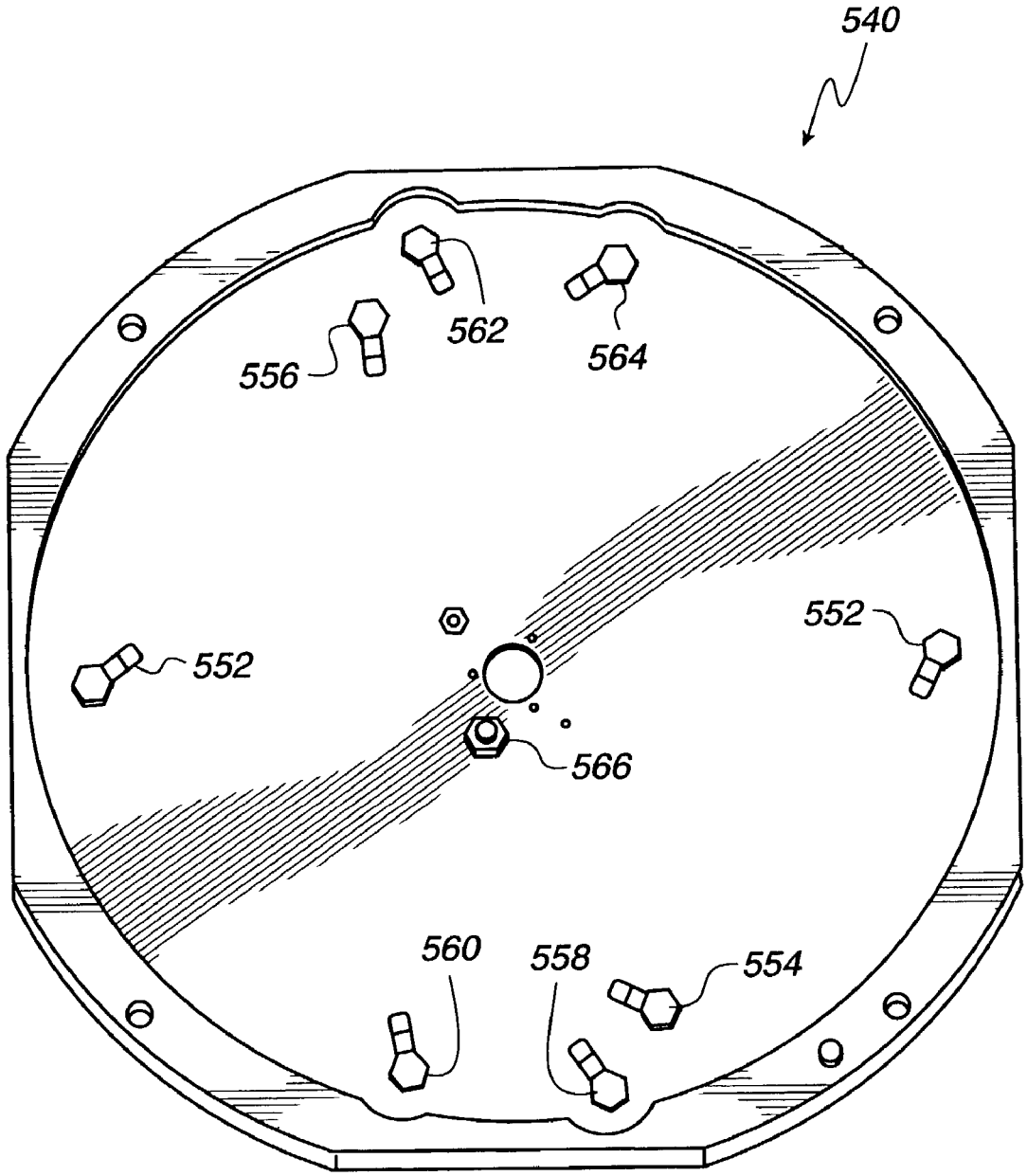
FIG. 9 shows a platen interface assembly in accordance with one embodiment of the present invention.

FIG. 9 shows a platen interface assembly 540 in accordance with one embodiment of the present invention. It should be appreciated that the platen interface assembly 540 may include any number of input holes depending on the number of zones and/or sub regions being controlled. In one embodiment, the platen interface assembly 540 includes 9 input holes. In one embodiment, two input holes 552 feed fluid into the plurality of output holes in regions 110*b* and 110*c* (regions 110*a*–110*e*, subregions 110*a*'–110*a*'" and subregions 110*d*'–110*d*'" are shown in FIGS. 4B and 7) of the platen manifold assembly 110. In addition, input holes 558, 560, and 554 may feed fluid into the plurality of output holes in sub regions 110*a*'–110*a*'" respectively. Also, input holes 562, 564, and 556 may feed fluid into the plurality of output holes in sub regions 110*d*'–110*d*'" respectively. Finally, an input hole 566 may feed fluid to the sub region 110*e*. By varying fluid entry into the input holes 552–566, fluid output out of each of the regions on the platen may be controlled individually or in any combination to intelligently adjust fluid pressures (and polishing pressure) on different parts of the polishing pad to increase equalization of polishing pressures on the different regions of the wafer thereby generating more consistent wafer polishing.

FIG. 10 shows a platen assembly 600 with a platen manifold assembly 110, a platen interface assembly 540, and a platen surround plate 116 in accordance with one embodiment of the present invention. It should be understood that the platen assembly 600 may be a one piece apparatus with the regions including the plurality of output holes built into the one piece apparatus, or the platen assembly 600 may include a multi-piece apparatus including the platen manifold assembly 110 attached to the platen interface assembly 540 where the platen manifold assembly 110 is fitted into the platen surround plate 116. The o-ring 110-2 forms a seal between the platen manifold assembly 110 and the platen surround plate 116 so that contaminating fluids do not leak into the subsystem. Regardless of the construction of the platen assembly 600, it may control fluid pressure through use of different plurality of output holes in different regions of the platen assembly 600. In one embodiment, the platen assembly 600 includes the platen manifold assembly 110, which has multiple zones of the plurality of output holes that is placed into and connected with a recess in the platen surround plate 116. The platen assembly 600 may include inputs 552, 554, 558, 560, 562, 564, and 566, which may introduce fluid into the different regions of the platen assembly 600.

It should be understood that any type of fluid may be utilized in the present invention to adjust pressure on the polishing pad from the platen manifold assembly 110 such as, for example, gas, liquid, and the like. Such fluids may be utilized in the present invention to equalize polishing pressure on a wafer. Therefore, by use of any type of fluid compound, the plate structure may control individual outputs into certain regions of the platen manifold assembly 110.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A method for improved wafer planarization in a chemical mechanical planarization (CMP) process, comprising the operations of:

adjusting pressure to a polishing belt utilizing a platen having an inner set of pressure sub regions disposed below a wafer and within a circumference of the wafer; and adjusting pressure to the polishing belt utilizing an outer set of pressure sub regions of the platen, the outer set of pressure sub regions being disposed below the wafer and outside the circumference of the wafer, the outer set of pressure sub regions being further capable of shaping the polishing belt to achieve a particular removal rate.

2. A method as recited in claim 1, wherein the outer set of sub regions includes a first outer sub region and a second outer sub region.

3. A method as recited in claim 2, further comprising the operation of independently adjusting the pressure provided by the first outer sub region and the second outer sub region.

4. A method as recited in claim 1, further comprising the operation of independently adjusting pressure provided in a leading zone and a trailing zone of the platen, each of the leading zone and the trailing zone including an inner set of pressure sub regions and an outer set of pressure sub regions.

5. A method as recited in claim 4, wherein the outer set of sub regions of each of the leading zone and the trailing zone includes a first outer sub region and a second outer sub region.

6. A method as recited in claim 5, further comprising the operation of independently adjusting pressure provided by the first outer sub region and the second outer sub region.

* * * * *